US005394126A

United States Patent [19]

Grunert et al.

[11] Patent Number: 5,394,126

[45] Date of Patent: Feb. 28, 1995

[54] CIRCUIT BREAKER WITH IMPROVED MAGNETIC TRIP ASSEMBLY

[75] Inventors: Kurt A. Grunert; William E. Beatty, both of Beaver, Pa.

[73] Assignee: Eaton Corporatiion, Cleveland, Ohio

[21] Appl. No.: 229,039

[22] Filed: Apr. 18, 1994

[51] Int. Cl.[6] ..... H01H 75/10

[52] U.S. Cl. ..... 335/42; 335/38

[58] Field of Search ..... 335/167-76, 335/21, 22, 23, 35, 38, 42, 40, 45

[56] References Cited

U.S. PATENT DOCUMENTS

| | | | |
|---|---|---|---|
| 3,815,059 | 6/1974 | Spoelman . | |
| 3,950,715 | 4/1976 | Bagalini et al | 335/174 |
| 4,630,019 | 12/1986 | Maier et al. . | |
| 4,691,182 | 9/1987 | Mrenna et al. | 335/176 |
| 4,719,438 | 1/1988 | Mrenna et al. | 335/38 |
| 4,958,136 | 9/1990 | Maier et al. . | |

*Primary Examiner*—Lincoln Donovan

*Attorney, Agent, or Firm*—Martin J. Moran

[57] ABSTRACT

A circuit breaker with improved magnetic trip assembly includes electrical contacts operable between a closed position in which a circuit is completed and an open position in which the circuit is interrupted, a latchable operating mechanism operable to open the electrical contacts when unlatched and a trip bar rotatable from a biased position to a trip position to unlatch the operating mechanism. The circuit breaker further includes a magnetic trip assembly comprising a stationary magnetic structure, a movable armature which is attracted to the stationary magnetic structure by an abnormal current through the conductor to rotate the trip bar to the trip position and a plate means mounted to the movable armature and disposed between the armature and the stationary magnetic structure. The plate means adjusts the amount of abnormal current required to attract the movable armature to the stationary magnetic structure and in turn rotate the trip bar.

9 Claims, 6 Drawing Sheets

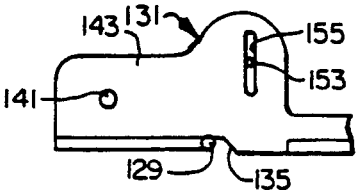
FIG. 10.
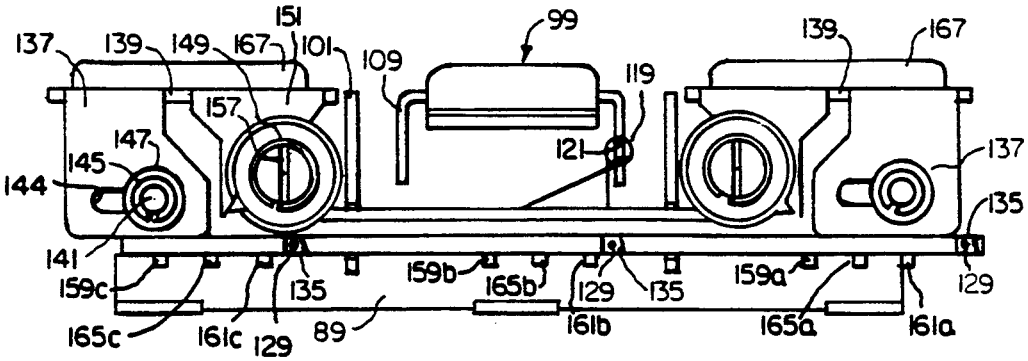
FIG. 7A.
FIG. 7B.
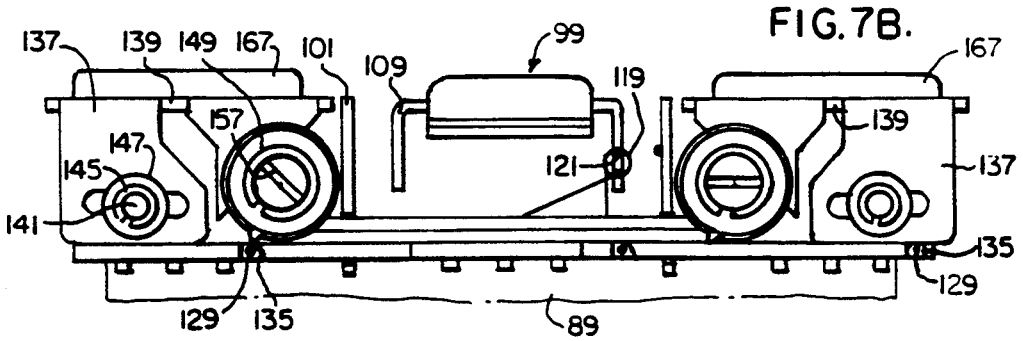
FIG. 8.
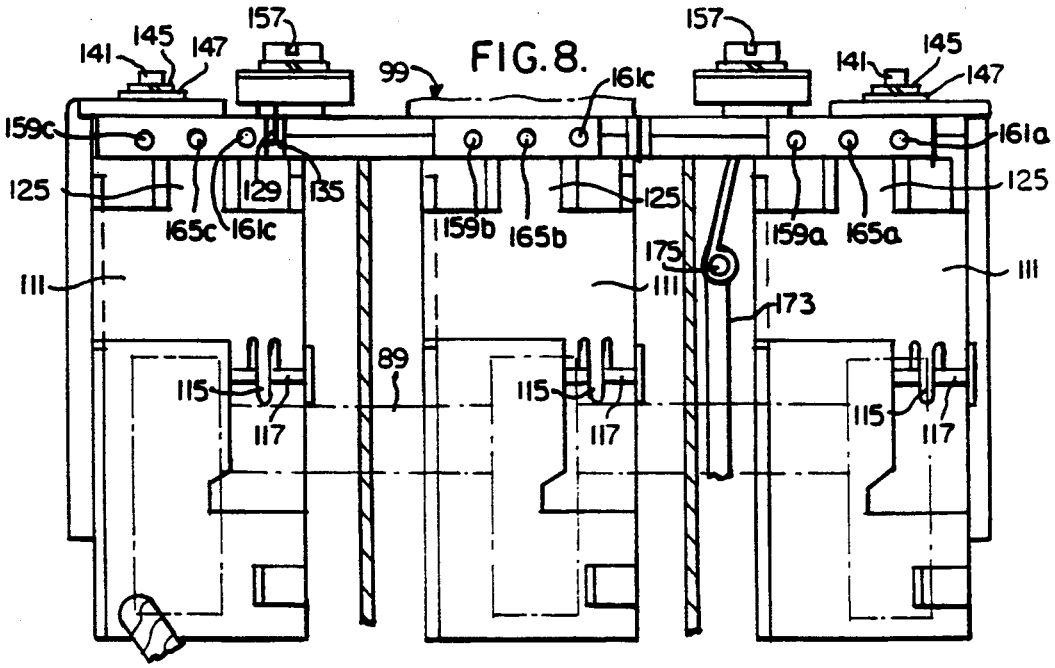

CIRCUIT BREAKER WITH IMPROVED MAGNETIC TRIP ASSEMBLY

BACKGROUND OF THE INVENTION

This invention relates to a circuit breaker with an improved magnetic trip assembly and more particularly to a magnetic trip assembly including a plate mounted to the armature and disposed between the armature and the stationary magnetic structure of the magnetic trip assembly to adjust the attraction force between the armature and the stationary magnetic structure.

Circuit breakers provide protection for electrical systems from electrical fault conditions such as current overloads and short circuits. Typically, circuit breakers include a spring powered operating mechanism which opens electrical contacts to interrupt the current through the conductors on an electrical system in response to abnormal currents. The operating mechanism is unlatched by a trip bar which in turn is operated by a trip mechanism associated with each phase of the electrical system. The trip mechanism can include a magnetic trip device comprising a fixed magnetic structure energized by the current flowing through the conductor, and a movable armature which is attracted toward the stationary magnetic structure to operate the trip bar. The trip bar in turn unlatches the operating mechanism to open the electrical contacts in each phase of the electrical system. The movable armature is biased away from the stationary magnetic structure by a spring thereby forming a gap between the armature and the stationary magnetic structure in the absence of an abnormal current.

Usually, means are provided for adjusting the level of current at which the magnetic trip device actuates the operating mechanism. Such adjustments can be made by varying the spring bias applied to the armature and/or mechanically adjusting the gap such as by varying the position of a threaded screw or cam against which the spring biases the armature. These adjustments permit fine tuning of the circuit breaker to assure that it will operate at the desired level of fault current. They can also be used to provide a range of settings at which the circuit breaker will trip. For instance, a circuit breaker may be rated to provide a range of trip settings between a low of say 500 amperes and a high of 1000 amperes.

During manufacturing of the circuit breakers, tests are performed to determine if the circuit breaker is performing properly at the rated trip settings. Using the example set forth above, the circuit breaker is tested at the low trip setting to see if the trip amps fall into an acceptable range, which is approximately plus or minus 10% (450 amps to 550 amps). The same testing is done for the high trip setting, with that range being also plus or minus 10% (900 amps to 1100 amps). Experience has shown that a substantial percentage of the circuit breakers fail one or both of these tests, leading to scrapping of the entire unit. The causes of these failures include discrepancies in the magnetic field caused by differences in materials used for the magnetic trip assembly, size differences (due to manufacturing tolerances) in the parts used in assembling the circuit breaker and incorrect or imprecise assembly of the various parts used for making the circuit breaker.

Thus, what is needed is a circuit breaker that includes a magnetic trip assembly having an adjustment means that can be used to compensate for the above-mentioned inevitable imperfections in the manufacturing and assembling processes.

SUMMARY OF THE INVENTION

The circuit breaker with improved magnetic trip assembly has met the above-mentioned need. The circuit breaker includes electrical contacts operable between a closed position in which a circuit is completed and an open position in which the circuit is interrupted, a latchable operating mechanism operable to open the electrical contacts when unlatched and a trip bar rotatable from a biased position to a trip position to unlatch the operating mechanism. The circuit breaker further includes a magnetic trip assembly comprising a stationary magnetic structure, a movable armature which is attracted to the stationary magnetic structure by an abnormal current through the conductor to rotate the trip bar to the trip position and a plate means mounted to the movable armature and disposed between the armature and the stationary magnetic structure. The plate means adjusts the attraction force between the armature and the stationary magnetic structure so that the amount of abnormal current required to rotate the trip bar to the trip position can be adjusted to fall into a desired range.

BRIEF DESCRIPTION OF THE DRAWINGS

A full understanding of the invention can be gained from the following description of the preferred embodiment when read in conjunction with the accompanying drawings in which:

FIG. 7A is a plan view of the portion of the circuit breaker shown in FIG. 4 illustrating the magnetic trip adjustment mechanism of the invention position in the high setting.

FIG. 7B is a plan view similar to FIG. 7A but illustrating the adjustment mechanism positioned to an intermediate setting.

FIG. 8 is a vertical section through the circuit breaker taken along a plane perpendicular to the left side of FIG. 4.

FIG. 10 is a plan view of a fragmentary part of the portion of the circuit breaker shown in FIGS. 7A and 8 with parts removed.

DETAILED DESCRIPTION

Figure 1:
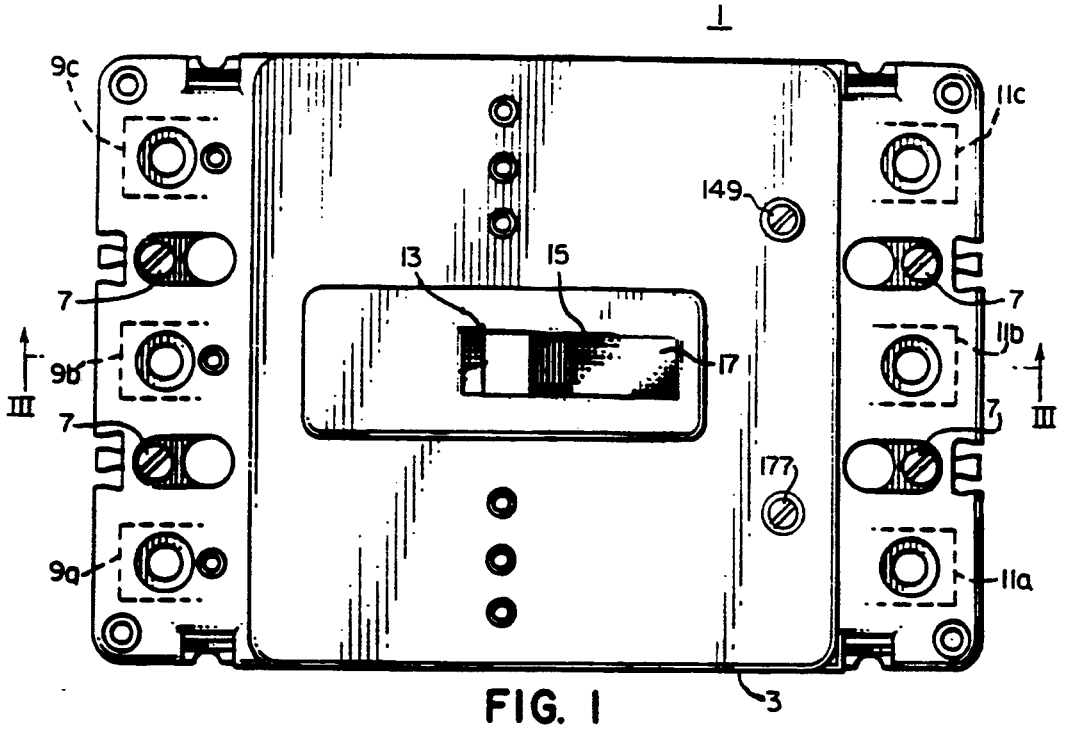
FIG. 1 is a top plan view of a circuit breaker incorporating the invention.
Figure 2:
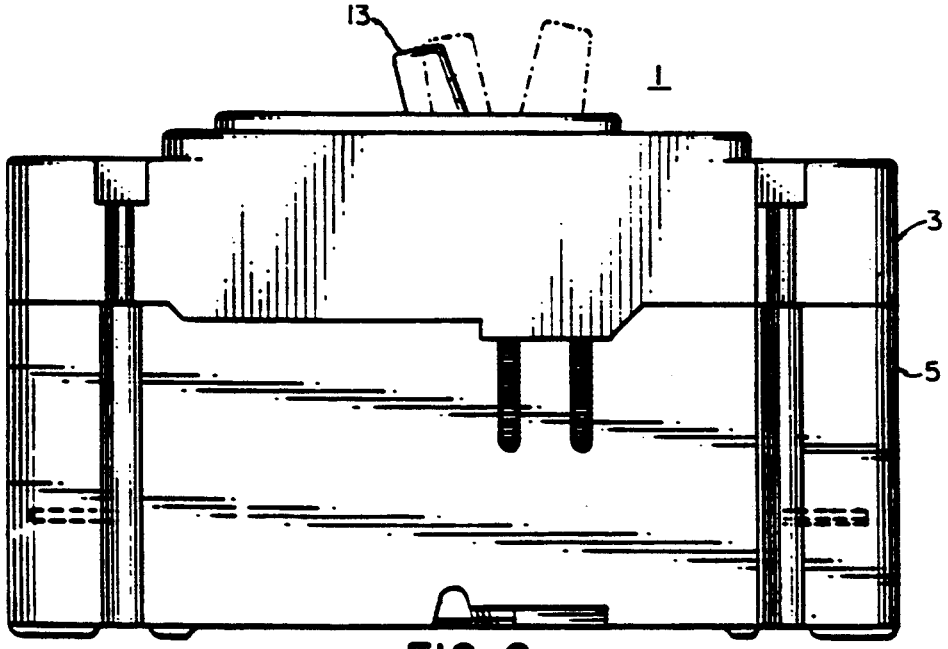
FIG. 2 is a side elevation view of the circuit breaker of FIG. 1.

Referring to the drawings, there is illustrated a molded case circuit breaker 1 incorporating a magnetic trip assembly with the improved means for adjusting the trip set point in accordance with the teachings of the invention. While the circuit breaker 1 is depicted and described herein as a three-phase, or three-pole circuit breaker, the principles of the invention are equally applicable to single phase or polyphase circuit breakers, and to both ac and dc circuit breakers.

The circuit breaker 1 includes a molded, electrically insulating, top cover 3 mechanically secured to a molded, electrically insulating, bottom cover or base 5 by fasteners 7. A set of first electrical terminals, or line terminals 9*a*, 9*b* and 9*c* are provided, one for each pole or phase. Similarly, a set of second electrical terminals, or load terminals 11*a*, 11*b* and 11*c* are provided at the other end of the circuit breaker base 5. These terminals are used to serially electrically connect circuit breaker 1 into a three-phase electrical circuit for protecting a three-phase electrical system.

Figure 6:
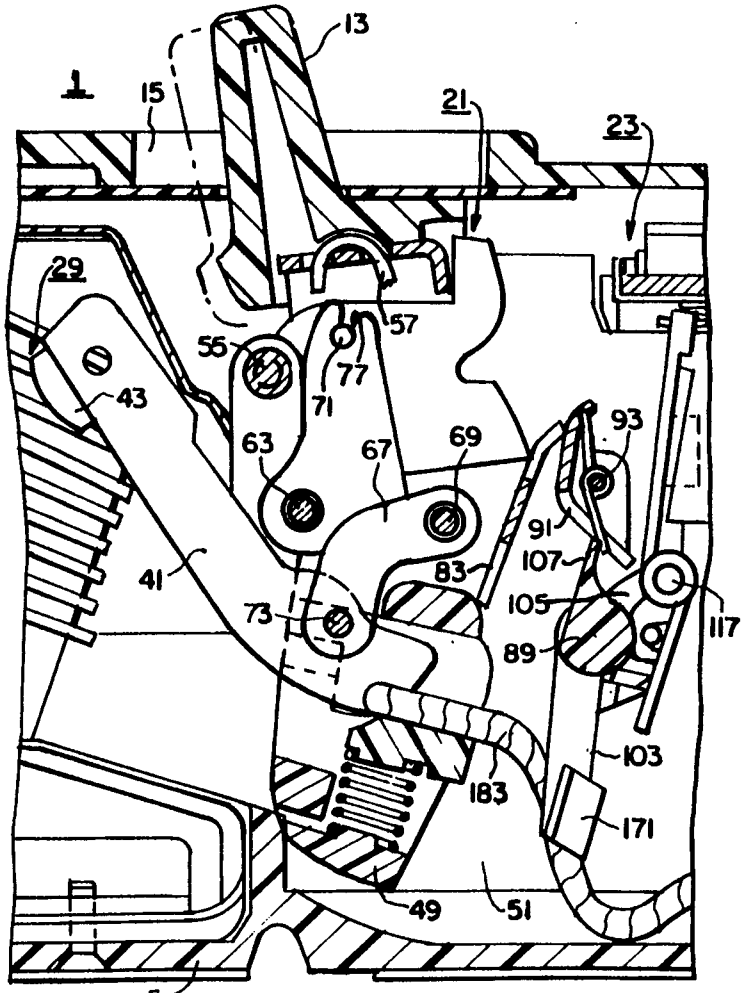
FIG. 6 is an enlarged vertical section of a portion of the circuit breaker of FIG. 1 taken along the same line as FIGS. 3 and 5, but showing the circuit breaker in the tripped position.
Figure 5:
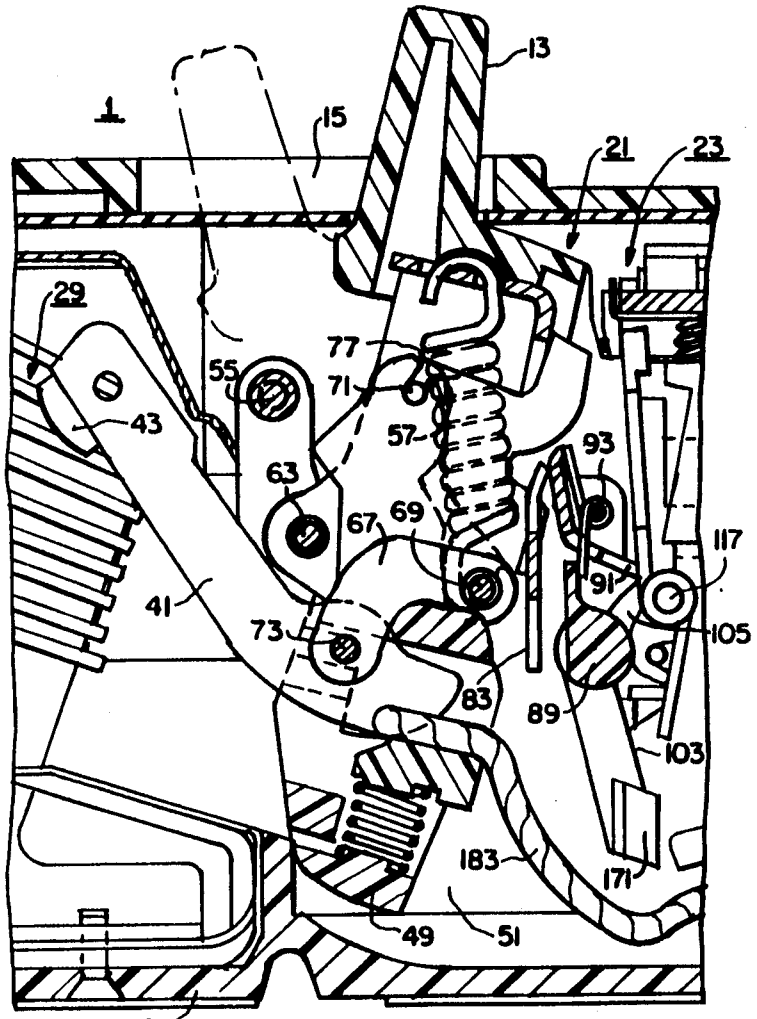
FIG. 5 is an enlarged vertical section of a portion of the circuit breaker of FIG. 1 taken along the same line as FIG. 3 but showing the circuit breaker in the open position.

The circuit breaker 1 further includes an electrically insulating, rigid, manually engaging handle 13 extending through an opening 15 in the top cover 3 for setting the circuit breaker 1 to its CLOSED position (FIG. 3) or its OPEN position (FIG. 5). The circuit breaker 1 may also assume a TRIPPED position (FIG. 6). Circuit breaker 1 may be reset from the TRIPPED position to the CLOSED position for further protective operation by moving the handle 13 through the OPEN position (FIG. 5). The handle 13 may be moved either manually or automatically by an operating mechanism 21 to be described in more detail. Preferably, an electrically insulating strip 17, movable with the handle 13, covers the bottom of the opening 15, and serves as an electrical barrier between the interior and the exterior of the circuit breaker 1.

As its major internal components, the circuit breaker 1 includes a set of electrical contacts 19 for each phase, an operating mechanism 21 and a trip mechanism 23. Each set of electrical contacts includes a lower electrical contact 25 and an upper electrical contact 27. Associated with each set of electrical contacts 19 are an arc chute 29 and a slot motor 31 both of which are conventional. Briefly, the arc chute 29 divides a single electrical arc formed between separating electrical contacts 25 and 27 upon a fault condition into a series of electrical arcs, increasing the total arc voltage and resulting in a limiting of the magnitude of the fault current. The slot motor 31, consisting of either of a series of generally U-shaped steel lamination encased in electrical insulation or of a generally U-shaped electrically insulated, solid steel bar, is disposed about the contacts 25, 27, to concentrate the magnetic field generated upon a high level short circuit or fault current condition thereby greatly increasing the magnetic repulsion forces between the separating electrical contacts 25 and 27 to rapidly accelerate their separation. The rapid separation of the electrical contracts 25 and 27 results in a relatively high arc resistance to limit the magnitude of the fault current. A more detailed description of the arc chute 29 and slot motor 31 can be found in U.S. Pat. No. 3,815,059.

The lower electrical contact 25 includes a U-shaped stationary member 33 secured to the base 5 by a fastener 35, a contact 37 for physically and electrically contacting the upper electrical contact 27 and an electrically insulating strip 39 to reduce the possibility of arcing between the upper electrical contact 27 and portions of the lower electrical contact 25. The line terminal 9 extending exteriorly of the base 5 comprises an integral end portion of the member 33.

The upper electrical contact 27 includes a rotatable contact arm 41 and a contact 43 for physically and electrically contacting the lower electrical contact 25.

The operating mechanism 21 includes an over-center toggle mechanism 47, an integral one-piece molded cross bar 49, a pair of rigid, spaced apart, metal side plates 51, a rigid, pivotable metal handle yoke 53, a rigid stop pin 55, a pair of operating tension springs 57 and a latching mechanism 59.

The over-center toggle mechanism 47 includes a rigid, metal cradle 61 that is rotatable about the longitudinal central axis of a cradle support pin 63 journalled in the side plates 51.

The toggle mechanism 47 further includes a pair of upper toggle links 65, a pair of lower toggle links 67, a toggle spring pin 69 and an upper toggle link follower pin 71. The lower toggle links 67 are secured to either side of the rotatable contact arm 41 of the upper electrical contact 27 by toggle contact pin 73° The ends of the pin 73 are received and retained in the molded cross bar 49. Thus, movement of the upper electrical contact 27, and the corresponding movement of the cross bar 49 are effected by movement of the lower toggle links 67. In this manner, movement of the upper electrical contact 27 by the operating mechanism 21 in the center pole or phase of the circuit breaker 1 simultaneously, through the rigid cross bar 49, causes the same movement in the electrical contacts 27 associated with the other poles or phases of the circuit breaker 1.

The upper toggle links 65 and lower toggle links 67 are pivotally connected by the toggle spring pins 69. The operating tension springs 57 are stretched between the toggle spring pin 69 and the handle yoke 53 such that the springs 57 remain under tension, enabling the operating of the over-center toggle mechanism 47 to be controlled by and be respective to external movement of the handle 13.

The upper links 65 also include recesses or grooves 77 for receipt and retention of pin 71. Pin 71 passes through the cradle 61 at a location spaced by a predetermined distance from the axis of rotation of the cradle 61. Spring tension from the springs 57 retains the pin 71 in engagement with the upper toggle links 65. Thus, rotational movement of the cradle 61 effects a corresponding movement or displacement of the upper portions of the links 65.

The cradle 61 has a slot or groove 79 defining a flat latch surface which is configured to engage a flat cradle latch surface formed in the upper end of an elongated slot or aperture 81 in a generally flat intermediate latch plate 83. The cradle 61 also includes a generally flat handle yoke contacting surface 85 configured to contact a downwardly depending, elongated surface 87 formed on the upper end of the handle yoke 53. The operating springs 57 move the handle 13 during a trip operation and the surfaces 85 and 87 locate the handle 13 in the TRIPPED position (FIG. 6) intermediate the CLOSED position (FIG. 3) and the OPEN position (FIG. 5) of the handle 13, to indicate that the circuit breaker 1 has tripped. In addition, the engagement of the surfaces 85 and 87 resets the operating mechanism 21 subsequent to a trip operation by moving the cradle 61 in a clockwise direction against the bias of the operating springs 57 from its TRIPPED position (FIG. 6) to and past its OPEN position (FIG. 5) to enable the relatching of the latching surfaces on groove 79 and in aperture 81.

Further details of the operating mechanism and its associated molded cross bar 49 can be gained from the description of the similar operating mechanism disclosed in U.S. Pat. No. 4,630,019.

The trip mechanism 23 includes the intermediate latch plate 83, a molded one-piece trip bar 89, a cradle latch plate 91, a torsion spring support pin 93, a double acting torsion spring 95, a magnetic trip assembly 97 and a thermal trip device 99 in the form of a bimetal.

The molded one-piece trip bar 89 is journalled in vertical partitions 101 in the base 5 of the molded case circuit breaker 1 which separate three poles of the circuit breaker. (See FIG. 7.) The trip bar 89 has actuating levers 103 for each pole extending radially downward. (See FIGS. 3, 5 and 6.) A trip lever 105 extending outwardly from the trip bar is engaged by the cradle latch plate 91. Cradle latch plate 91 is mounted for rotation about an axis parallel to the trip bar. One arm of the double acting torsion spring 95 biases the cradle latch plate 91 against the intermediate latch plate 81. The other arm of the torsion spring 95 bears against a vertical projection 107 on the trip bar 89 to bias the trip bar in the counter clockwise direction as viewed in FIG. 3.

Figure 3:
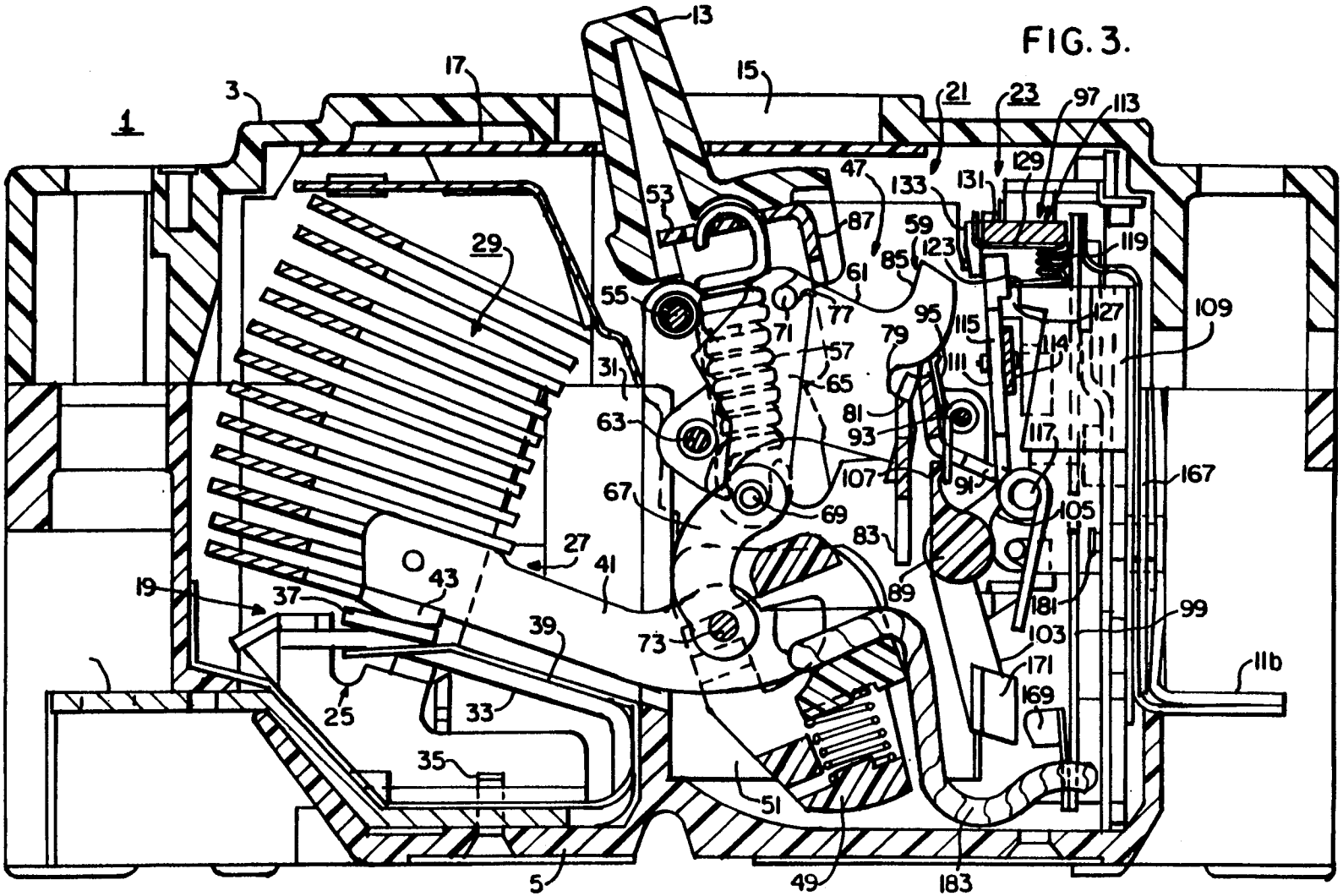
FIG. 3 is an enlarged vertical section through the circuit breaker of FIG. 1 taken along the line III—III in FIG. 1 and illustrating the circuit breaker in the closed position.

With the circuit breaker in the CLOSED position as shown in FIG. 3, the tension springs 57 tend to rotate the cradle 61 in the counter clockwise direction. This is resisted, however, by the cradle latch plate 91 held in place by the trip lever 105 on the trip bar 89 and acting through the intermediate latch plate 83.

The magnetic trip assembly 97 includes a stationary magnetic structure 109, an armature 111, and means 113 for adjusting the magnetic trip. Mounted to the armature 111 is the rotatable plate means 114 of the invention which will be described in detail below with respect to FIGS. 11 to 14. The planar armature 111 is bent along a horizontal axis and slotted at 115 for receipt of a pin 117 about which the armature is rotatable.

The adjusting means 113 includes a helical torsion spring 119 supported on a vertical projection 121 (see FIG. 7A). The torsion spring 119 has one spring arm 123 which bears against an upwardly projecting tongue 125 on the armature 111 to bias the armature away from the stationary magnetic structure 109 to form a gap 127 therebetween. The outer spring arm 129 of the spring 119 is engaged by an adjusting bar 131. The adjusting bar 131 includes a depending lip 133 against which the arm 123 of the torsion spring 119 biases the tongue 125 on the armature 111. The upper spring arms 129 of the torsion springs 119 are engaged by notches 135 in the lip 133.

The adjustment bar 131 is supported for rectilinear, longitudinal movement by first horizontal ledges 137 on brackets 139. Upstanding pins 141 on enlarged portions 143 at each end of the adjustment bar 131 extend upward through elongated slots in the ledges 139 (see FIGS. 7 and 10).

Snap rings 145 received in grooves (not shown) in the pins 141 slidably connect the adjustment bar 131 to the bracket ledges 137. Washers 147 are provided between the snap rings 145 and the ledges 137.

A rotatable camming mechanism 149 mounted on a second raised ledge 151 on the bracket 139 adjacent one end of the adjustment bar 131 has an eccentric, depending pin 153 which engages a transverse slot 155 in the enlarged end 143 of the adjustment bar 131. Rotation of the camming device 149 by insertion of a tool such as a screw driver into a slot 157 provide the capability of rectilinearly moving the adjustment bar longitudinally. As can be seen from FIG. 1, the rotatable camming device 149 is accessible through the cover 3 on the circuit breaker 1 to provide means for adjusting the position of the adjusting bar 131 without removing the cover.

Since the spring arms 129 of the torsion spring 119 biasing each of the armatures 111 are engaged by slots 135 in the adjustment bar 131, the bias on the armature 111 for each pole can be adjusted simultaneously by rotating the rotatable camming device 149. With the adjustment bar 131 at the full right end of its travel as shown in FIG. 7A, maximum spring bias is applied to the armatures 111 by the springs 119. This provides the high setting for the range of settings of the magnetic trip for the circuit breaker 1.

In order to individually fine tune the setting of each pole of the circuit breaker 1 at this high setting, first projections in the form of screws 159*a*, 159*b* and 159*c* are threaded through the depending flange 133 on the adjustment bar 131 and bear against the back of the tongue 125 on the associated armature. By adjusting the extend that the screws 159*a*, 159*b* and 159*c* project beyond the flange 133, the gap 127 between the armature 111 and the stationary magnetic structure 109 can be individually adjusted for each pole. Thus, while the adjustment bar sets the spring tension on all three poles simultaneously to the high setting, separate adjustment can be made to fine tune the high setting of each pole by use of the screws 159*a*, 159*b* and 159*c*.

When the adjustment bar is moved to the far left, spring bias on each armature 111 is reduced to the low setting for the magnetic trip. With the adjustment bar 131 in this position a set of second projections in the form of screws 161*a*, 161*b* and 161*c* threaded through the flange 133 of the adjustment bar 131 are aligned with the tongue 125 on the associated armature and permit separate adjustment of the gap at this low setting for each of the poles of the circuit breaker 1.

Figure 9A:
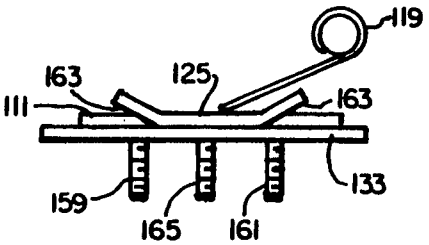
FIGS. 9A, B and C are schematic drawings illustrating the position of the magnetic trip adjustment bar in the intermediate setting, the high setting, and the low setting, respectively.
Figure 9B:
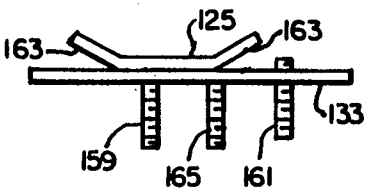
Figure 9C:
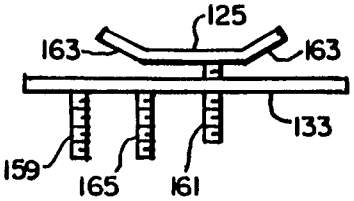

As will be seen from the schematic sketches of FIGS. 9A, 9B and 9C, the adjusting screws 159 are only aligned with the tongue 125 with the armature 111 when the adjusting bar is positioned to the high magnetic trip setting shown in FIG. 9B. In this position, the screw 161 has no effect on the gap setting of the armature 111. Conversely, with the adjustment bar 131 position to the low magnetic trip setting shown in FIG. 9C, the screw 161 is aligned with tongue 125 to provide adjustment to the gap 127. The side edges 163 of the tongues 125 on the armatures 111 are inclined at an angle to the plane of the armature 111 to provide camming surfaces which guide the armature 111 into the gap setting position established by the screws 159 and 161 as the adjustment bar approaches the high and low setting at the high and low spring bias setting to be set independently, and separately for each pole.

An additional set of screws 165*a*, 165*b* and 165*c* can be provided between the screws 159 and 161 adjacent each pole and aligned to bear against the tongue of the associated armature through the entire range of travel of the adjusting bar 131. This additional set of screws remain in contact with the associated armature through the entire range of travel of the adjusting bar 131. This additional set of screws remain in contact with the associated tongue 125 throughout the entire range of settings of spring bias, and therefore provides additional flexibility in adjusting the gap 127. With the adjusting bar 131 set in the middle of its travel, as shown in FIGS. 9A and 7B, only the adjusting screws 165*a*, 165*b* and 165*c* are aligned with the tongues 125 and the gap is set for the entire range of spring bias settings.

Figure 4:
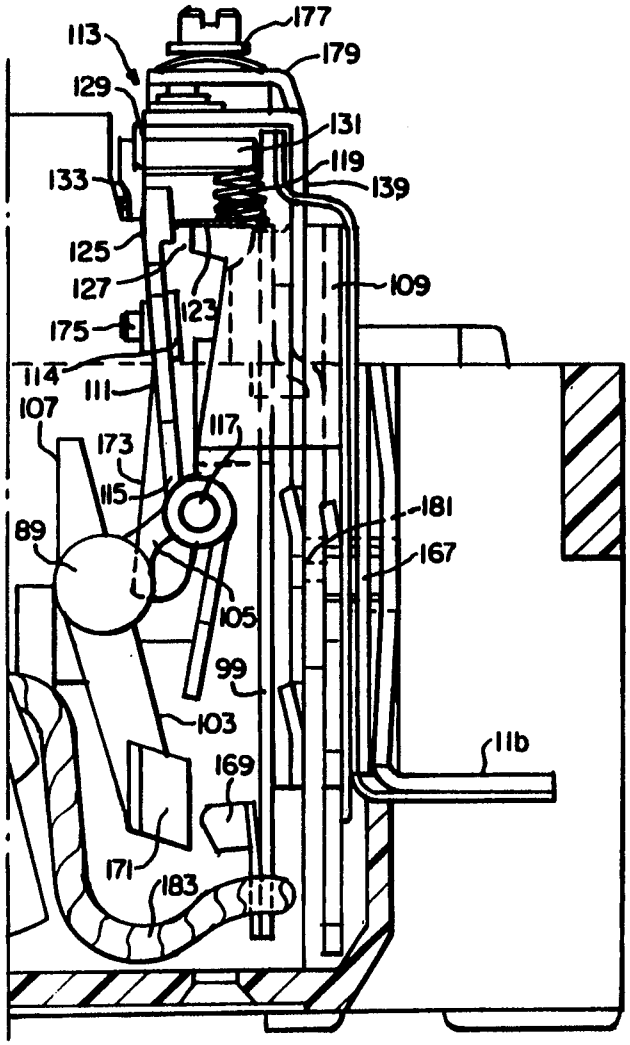
FIG. 4 is an enlarged vertical section of a portion of the circuit breaker of FIG. 1 with the casing removed.

The bimetal 99 is electrically connected to the load terminal 11*b* through a conductive member 167. The lower end of the bimetal 99 is provided with a finger 169 which is spaced from a bevelled surface 171 on the lower end of the actuating arm 103 on the trip bar 89. The bevelled surface 171 defines a plane having the left edge as viewed in FIG. 3 closer than the right edge. Adjustment of the spacing between the finger 169 and surface 171 can be accomplished by two means. A lever arm 173 pivoted for rotation about a pin 175 engages the trip bar 89 at its lower end as seen in FIG. 4. The upper end of the lever arm 173 is engaged by a rotatable camming device 177 mounted on a ledge 179 on the bracket 139. The camming device 177 is similar to the device 149. Rotation of the camming device 177 causes the lever arm 173 to rotate sliding the trip bar 89 axially. Due to the bevelled surface 171 on the actuating lever 103, spacing between the bimetal and the trip bar is adjusted. The camming device 177 is also accessible through the top cover of the circuit breaker 1 as shown in FIG. 1. Calibration of the bimetal can be effected at the factory through rotation of a screw 181.

A current bearing conductive path between the lower end of the bimetal 99 and the upper electrical contact 27 is achieved by a flexible copper shunt 183 connected by any suitable means, for example by brazing to the lower end of the bimetal 99 and to the upper electrical contact 27 within the cross bar 49. In this manner, an electrical path is provided through the circuit breaker 30 between the terminals 9*b* and 11*b* via the lower electrical contact 25, the upper electrical contact 27, the flexible shunt 183, the bimetal 99, and the conductive member 167.

Adjustment of the camming device 177 varies the response time of the circuit breaker to low level over currents. Since the bimetal 99 is surrounded by the stationary magnetic structure 109, the current conducted by the bimetal generates a magnetic field in the stationary magnetic structure which attracts the armature 111. The spring bias set by adjustment of the adjusting bar 131 through rotation of the camming device 149 adjusts the level of current at which the armature is attracted to the stationary magnetic structure. The screws 159, 161 and 165 provide for fine adjustment of the trip current at the high, low and all settings of spring bias respectively.

Once the circuit breaker leaves the factory and is delivered to the customer, in operation, the circuit breaker 1 is set to the CLOSED position as shown in FIG. 3. A current which exceeds the magnetic trip setting established by the spring bias through the camming device 149, the adjusting screws 159, 161 and 165 and the position of the plate means 114 generates a magnetic field in the stationary magnetic structure 109 sufficient to pull the armature 111 and the plate means 114 toward it in a clockwise direction is viewed in FIG. 3. The lower end of the armature rotates the trip bar in the clockwise direction until the cradle latch plate 91 slides off of the trip lever 105. This unlatches the cradle 61 permitting the operating tension springs 57 to rotate the cradle 61 counter-clockwise as viewed in FIG. 3 which causes the toggle mechanism 47 to break over to the position shown in FIG. 6 thereby opening a set of electrical contacts 19. As previously mentioned, this results in rotation of the cross bar 49 which opens the sets of contacts 19 on each of the poles of the circuit breaker 1.

In a similar manner, a persistent low level current causes the bimetal 99 to bend bringing the finger 169 into contact with the camming surface 171 of the trip lever 105 on the trip bar 89 thereby rotating the trip bar 89 and tripping the circuit breaker in the manner discussed above in connection with the magnetic trip.

With the circuit breaker tripped, the contacts are opened as shown in FIG. 6. The circuit breaker 1 is reset by moving the handle 13 to the OFF position as shown in FIG. 5. This rotates the cradle 61 to a position where the cradle latch plate 91 biased by the latch torsion spring 95 urges the intermediate latch plate 83 into engagement with the latching surface of the groove 79 in the cradle 61. The latch torsion spring 95 also rotates the trip bar counter-clockwise until the cradle latch plate 91 is engaged and retained in a latched position by the lever 105 on the trip bar 89 as shown in FIG. 5. The trip mechanism 23 is thus relatched and ready for closing of the circuit breaker by movement of the handle 13 to the CLOSED position shown in FIG. 3. This causes the toggle mechanism 47 to rotate counter-clockwise over center, thereby closing the sets of electrical contacts 19 of each pole.

Figure 11:
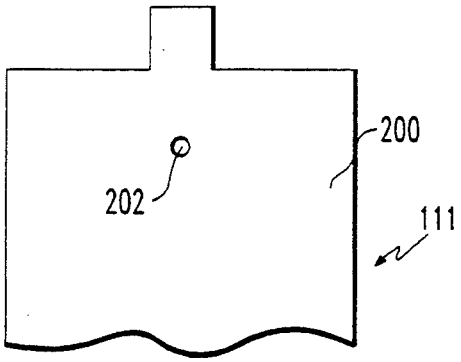
FIG. 11 is a front elevational view of the armature of the invention.
Figure 12:
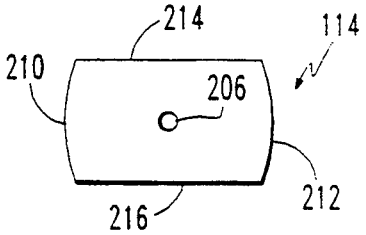
FIG. 12 is a front elevational view of the plate means of the invention.

Referring now to FIG. 3 and FIGS. 11–14, the improved magnetic trip assembly of the invention will be discussed. As was discussed above, the armature 111 has mounted thereto a plate means 114 which is disposed between the armature 111 and the stationary magnetic structure 109. Referring now to FIG. 11, the upper portion 200 of the armature 111 which is conventional except for the provision of a mounting hole 202 which is substantially centered thereon. FIG. 12 shows the plate means 114 of the invention. Plate means 114 is preferably generally rectangular in shape and also has a mounting hole 206 centered therein. The plate means 114 has slightly radiussed short sides 210, 212 and generally straight longer sides 214, 216. The plate means 114 has preferably radiussed sides in order to facilitate shunting of the magnetic field from the high to the low trip amp settings and also to adjust the attraction force between the armature 111 and the stationary magnetic frame 189. The plate means 114 is preferably about one-sixteenth of an inch in thickness and is made of ASTM Grade 1010 cold rolled steel.

Figure 13:
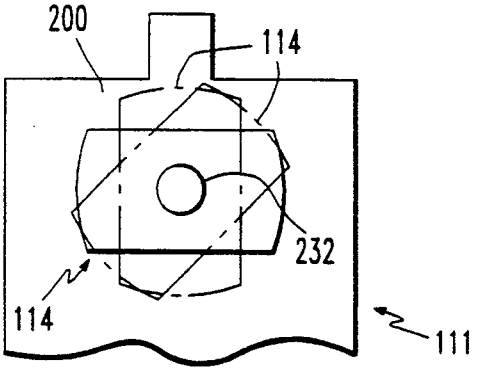
FIG. 13 is an elevational view of the plate means mounted to the armature.
Figure 14:
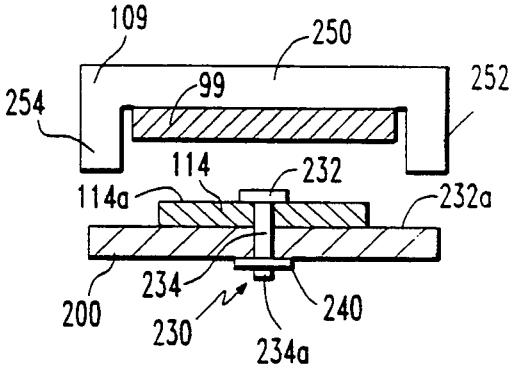
FIG. 14 is a sectional view showing the plate means mounted to the armature and also the stationary magnetic frame.

Referring now to FIGS. 13 and 14, the plate means 114 is shown mounted to the armature 111. As can best be seen in FIG. 12, the plate means 114 is disposed between the armature 111 and the bimetal 99 mounted in the stationary magnetic frame 109. The plate means 114 is mounted to the armature 111 is mounted to the armature 111 by mechanical mounting means consisting of a rivet 230 having a head portion 232 and a shaft portion 234, the shaft portion 234 passing through hole 202 of armature 111 and hole 206 of the plate means 114. The head portion 232 has a larger diameter than hole 206 of the plate means 114 and its underside 232*a* is in intimate surface-to-surface contact with surface 114*a* of the plate means 114.

Figure 15:
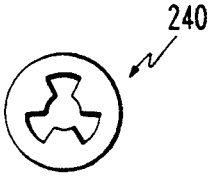
FIG. 15 is a perspective view of the star clip used in the mechanical mounting means.

The shaft portion 234 has a free end 234*a* that projects from surface 111*a* of the armature 111. The free end also includes a groove that is adapted to be engaged by a screwdriver or hex wrench in order to rotate the plate means 114 relative to the armature 111. Disposed on that free end 234*a* is a star clip 240 (see FIG. 15) which acts to fasten together the armature 111 and plate means 114. The mechanical mounting means is designed such that it securely fastens the armature 111 to the plate means 114 but not so securely fastened that rotation of the plate means 114 relative to the armature 111 (discussed below) is prevented. Preferably, the contacting surfaces of the armature 111 and the plate means 114 have complementary die-cut surfaces consisting of grooves which cause the armature 111 and the plate means to be aligned and which also resist undesired rotation of the plate means 114 relative to the armature 111.

The stationary magnetic structure 109 is generally U-shaped and includes a base portion 250 and two generally parallel sidewalls 252 and 254 which extend generally perpendicularly from the base portion 250. It will be appreciated that when the armature 111 is attracted to the stationary magnetic structure 109 due to an abnormal current in the circuit breaker, that portions of the armature 111 contact the sidewalls 252, 254. As can best be seen in FIG. 12, the plate means 114 is constructed and arranged such that the plate means 114 does not interfere with the armature 111 contacting the sidewalls 252, 254 of the stationary magnetic structure 109 when the armature 111 is attracted to the stationary magnetic structure 109.

As can be seen in FIG. 13, the plate means 114 is rotatable relative to the armature 111. The so-called horizontal position (0°) is shown in solid line drawing on FIG. 13. Shown in phantom line drawing are two other positions, the 45° position and the vertical position (90°). It will be appreciated that other positions between 0° and 90° can be used and it will also be appreciated that the range of positions is from 0°–90° even though the plate means 114 is fully rotatable (360°) relative to the armature. It will further be appreciated that the plate means 114 can be any shape, other than a circle, which has the mounting hole at its center. This is because when a non-circular shape is rotated the attraction force between the armature 111 and the stationary magnetic structure 109 changes.

By adjusting the position of the plate means 114 relative to the armature 111, the attraction force required to attract the armature 111 to the stationary magnetic structure 109 can be adjusted. It has been determined that the horizontal position (0°) corresponds to a low trip amp setting and the vertical position (90°) corresponds to a high trip setting. By "horizontal position" it is meant that the longer straight sides 214, 216 are generally parallel to the axis of rotation of the trip bar 89 and by "vertical position" it is meant that sides 214, 216 are generally perpendicular to the axis of rotation of the trip bar 89.

Once the circuit breaker is assembled, it is tested to see if the trip amps match the requirements of the circuit breaker. Conventionally, the circuit breaker is initially set to trip at an amperage of slightly greater than the low trip amp setting. The plate means 114 is then positioned in the vertical (90°) setting. The circuit breaker then is tested by pulsing a current therethrough to see if the trip amps fall into a tolerable range, which conventionally is about plus or minus 10%. If the test reveals that the circuit is tripping at too high a current, the plate means 114 are rotated from the vertical position in order to bring the low trip amps down. This process continues until the trip amps are in an acceptable range.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A circuit breaker for responding to abnormal currents in a conductor in an electrical system, said circuit breaker comprising:

electrical contacts operable between a closed position in which a circuit is completed through said conductor and an open position in which said circuit through said conductor is interrupted;

a latchable operating mechanism operable to open said electrical contacts when unlatched;

a trip bar rotatable from a biased position to a trip position to unlatch said operating mechanism; and a magnetic trip assembly comprising:

a stationary magnetic structure;

a movable armature which is attracted to said stationary magnetic structure by an abnormal current through said conductor to rotate said trip bar to said trip position; and plate means mounted to said movable armature and disposed between said movable armature and said stationary magnetic structure to adjust the amount of said abnormal current required to attract said movable armature to said stationary magnetic structure and in turn rotate said trip bar to said trip position.

2. The circuit breaker of claim 2, wherein said plate means is mounted to said movable armature by mechanical mounting means which securely mounts said plate means to said movable armature when said plate means is in a desired position relative to said movable armature but which also allows said plate means to be moved relative to said armature when it is desired to change the position of said movable plate means relative to said movable armature.

3. The circuit breaker of claim 2, wherein said plate means is rotatably mounted to said movable armature by mechanical mounting means.

4. The circuit breaker of claim 3, wherein said plate means is asymmetrically shaped such that rotation of said plate means adjusts said amount of abnormal current required to attract said movable armature to said stationary magnetic frame.

5. The circuit breaker of claim 4, wherein said plate means is rotatable over a range from a high trip amp setting to a low trip amp setting.

6. The circuit breaker of claim 5, wherein said plate means is generally rectangular in shape having a first longer side and a second shorter side; and said plate means is in said low trip amp setting when said first longer side is generally parallel to the axis of rotation of said trip bar and said plate means is in said high trip amp setting when said second shorter side is generally perpendicular to said axis of rotation of said trip bar.

7. The circuit breaker of claim 6, wherein said stationary magnetic structure is generally U-shaped having a base portion and two sidewalls extending from said base portion towards said armature;

said movable armature has portions which contact said sidewall when said movable armature is attracted to said stationary magnetic structure; and said plate means is positioned on said movable armature and is dimensioned such that said rotatable plate means does not contact said sidewalls of said stationary magnetic structure when movable said armature is attracted to said stationary magnetic structure.

8. The circuit breaker of claim 7, wherein said second shorter sides are radiussed.

9. The circuit breaker of claim 1, including a molded case in which said electrical contacts, latchable operating mechanism, trip bar and magnetic trip assembly are housed such that said rotatable plate means cannot be accessed without opening said molded case.

* * * * *